US006012775A

United States Patent [19]

Czarnecki

[11] Patent Number: 6,012,775

[45] Date of Patent: Jan. 11, 2000

[54] ADJUSTABLE HELMSMAN'S CHAIR

[76] Inventor: Robert F. Czarnecki, Box 220, Rd One, Greensburg, Pa. 15601

[21] Appl. No.: 08/870,876

[22] Filed: Jun. 6, 1997

[51] Int. Cl.[7] ..... A47C 1/02

[52] U.S. Cl. ..... 297/344.13; 297/344.19; 297/423.38

[58] Field of Search ..... 297/217.3, 344.1, 297/344.13, 344.12, 344.18, 344.19, 344.2, 344.21, 344.22, 344.24, 423.38; 114/188, 194, 363; 248/157, 161, 344.17, 404, 344.16

[56] References Cited

U.S. PATENT DOCUMENTS

| | | | |
|---|---|---|---|
| 2,653,648 | 9/1953 | Marshall | 297/344.19 |
| 3,642,320 | 2/1972 | Ward | 297/423.38 X |
| 4,008,500 | 2/1977 | Hall, Jr. | 297/217.3 X |
| 4,143,436 | 3/1979 | Jones | 114/363 |
| 4,234,989 | 11/1980 | Pearcy | 297/344.19 X |
| 4,425,863 | 1/1984 | Cutler | 297/423.38 X |
| 4,928,620 | 5/1990 | Currey | 297/344.21 X |
| 5,090,770 | 2/1992 | Heinrichs et al. | 297/344.19 |
| 5,458,399 | 10/1995 | Gezari et al. | 297/217.3 X |

FOREIGN PATENT DOCUMENTS

| | | | |
|---|---|---|---|
| 2097756 | 11/1982 | United Kingdom | 297/423.38 |

*Primary Examiner*—Milton Nelson, Jr.
*Attorney, Agent, or Firm*—Jon M. Lewis, Esquire

[57] ABSTRACT

An adjustable helmsman's chair is mounted onto a boat deck. The chair rotates and is raised and lowered hydraulically by operation of an integral switch attached to the chair. The chair includes a lock that prevents rotation and vertical movement when engaged. The chair also is slidable horizontally as desired to maximize a helmsman view. A foot rest is provided for convenience.

10 Claims, 6 Drawing Sheets

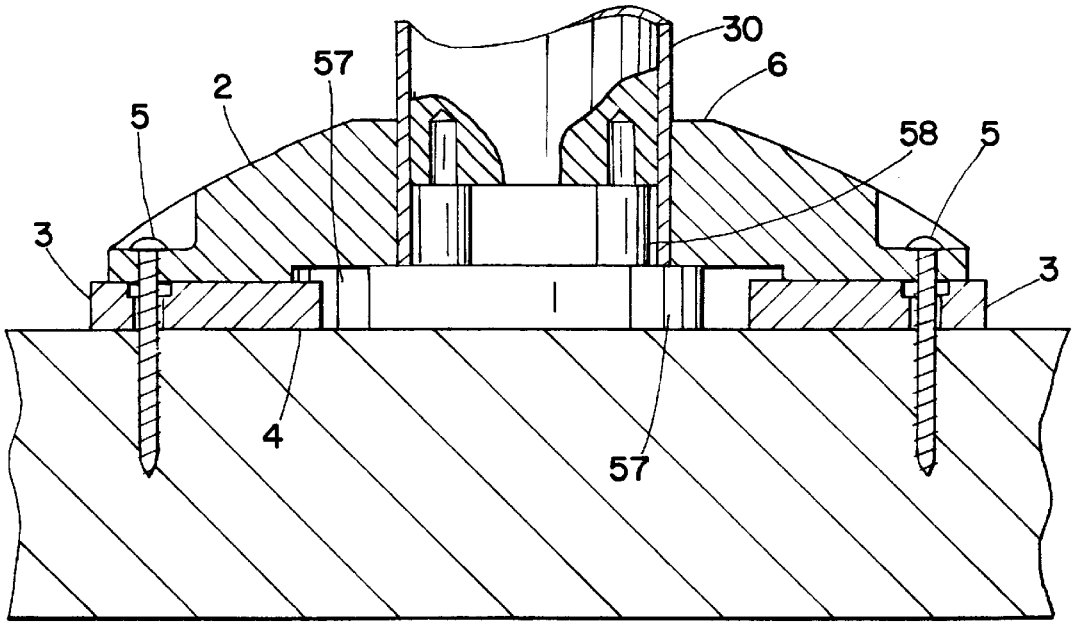
Fig. 9
Fig. 10
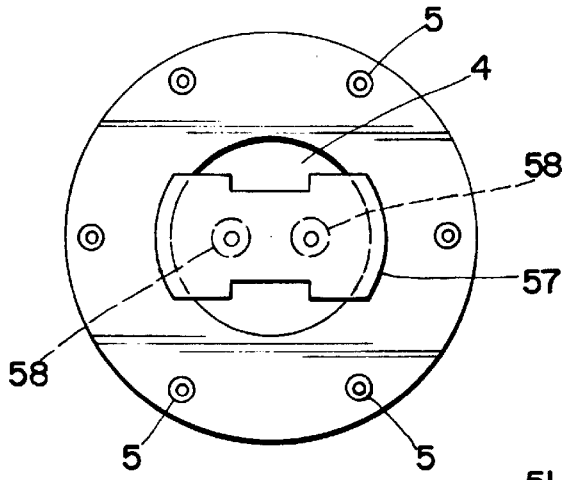
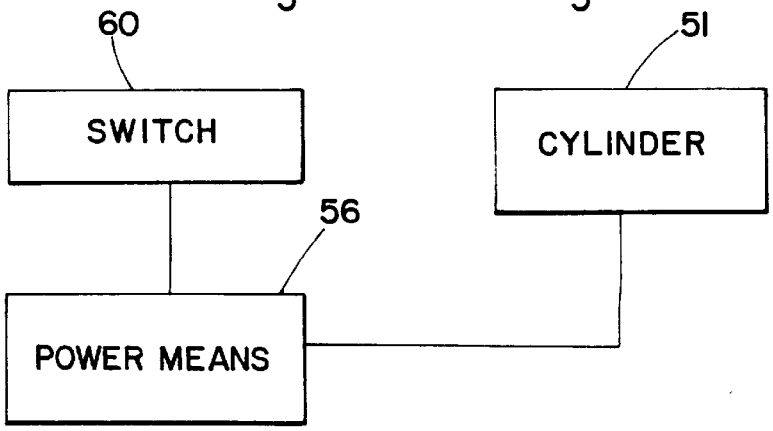
Fig. 11

ADJUSTABLE HELMSMAN'S CHAIR

BACKGROUND OF THE INVENTION

My invention relates to helmsman's chairs and in particular an adjustable helmsman's chair for boats that is adjustable both vertically, horizontally, and rotationally. In the operation of a boat,-due to the peculiarities of particular boats, their speed[s] effects their attitude [of altitude] to the ocean or waves in the ocean. [the wave,] As speed increases, attitude may increase so that the front of the boat is higher at speed than at rest. This change in height of the front of the boat effects the helmsman's forward view. I[i]t is optimally desired to raise or lower the helmsman's chair so that a helmsman can have a proper view about the boat and the outside of the boat for the safe operation thereof. The helmsman may desire to rotate about the chair or to raise or lower the chair so as to optimally operate the boat. The chair preferably be raised when starting or accelerating to aid in forward view. During cruise, the chair would be preferably lowered to get out of the direct blast of wind. The helmsman's view height with my novel chair is adjusted as desired. Depending on such things as accelerating, speed, fishing, altitude of boat with the water and the size and height of the operator, in order to properly and safely operate the boat.

Numerous boat chairs have been provided in the past and have included articulated platforms such as U.S. Pat. No. 4,620,686 to CONANT which discloses an articulated chair. [that] It is adjustable vertically and horizontally [forwardly] to various desired positions through manual operation. Numerous vertically adjustable boat seats have been disclosed in the past such as that of U.S. Pat. No. 4,673,155 to BENDER. Other patents have provided for swivel supports such as that of U.S. Pat. No. 5,297,849 to CHANCELLOR.

It is also important that the chair can be able to be articulated so that it can move horizontally as well as vertically. Horizontal movement of a helmsman's chair is well known, but not in combination with vertical and rotational movement.

It is important to invention's operation that a lock be placed upon the chair so that the chair neither rotates or moves vertically when the lock is engaged. In addition, there is a need for said chair to be operated by use of a switch integral to the chair to raise and lower as well as rotating when desired.

Prior helmsman chairs are not believed to adequately address the desired adjustable movement with a way that securely holds the chair in place, is easy to operate and provides the desired adjustable functions of vertical, horizontal and rotational movement.

SUMMARY OF THE INVENTION

An object of the present invention is to provide a helmsman's chair that may be raised or lowered through the use of a switch integrally placed in the chair. In this manner, by operation of the switch the helmsman can vertically adjust the chair to a desired level.

Another object of the invention is to provide a chair that rotates so that a helmsman can look about the boat as desired.

An additional object of the invention is to provide a chair that can be moved horizontally as it elevates or rotates so that a helmsman can have a desired position for purposes of safety, desire, and position while operating his boat.

A further object of the invention is to provide a lock to prevent the chair from movement either vertically or rotationally when desired.

A still further object of the invention is to provide a foot rest that can be adjustable for the convenience of a helmsman.

Still another object of the invention is to provide a helmsman chair which is simple in construction, easy to fit within an existing boat, relatively safe from elements, and would be dependable in operation. The present invention, incorporating the elements discussed above, therefore, provides a helmsman chair that is conveniently moveable as a helmsman would desire. For more complete understanding of the invention and the objects and advantages thereof, reference is made to the following detailed description and the accompanying drawings where a preferred embodiment of the invention is described and illustrated.

BRIEF DESCRIPTION OF THE DRAWINGS

FIG. 9 is a rotated vertical section of the boat deck bracket with components shown in section taken along section line 9—9 of FIG. 1.

FIG. 10 is a top view of the boat deck bracket.

FIG. 11 is a block diagram of the hydraulic system of an adjustable helmsman's chair.

DESCRIPTION OF THE PREFERRED EMBODIMENT

Figure 1:
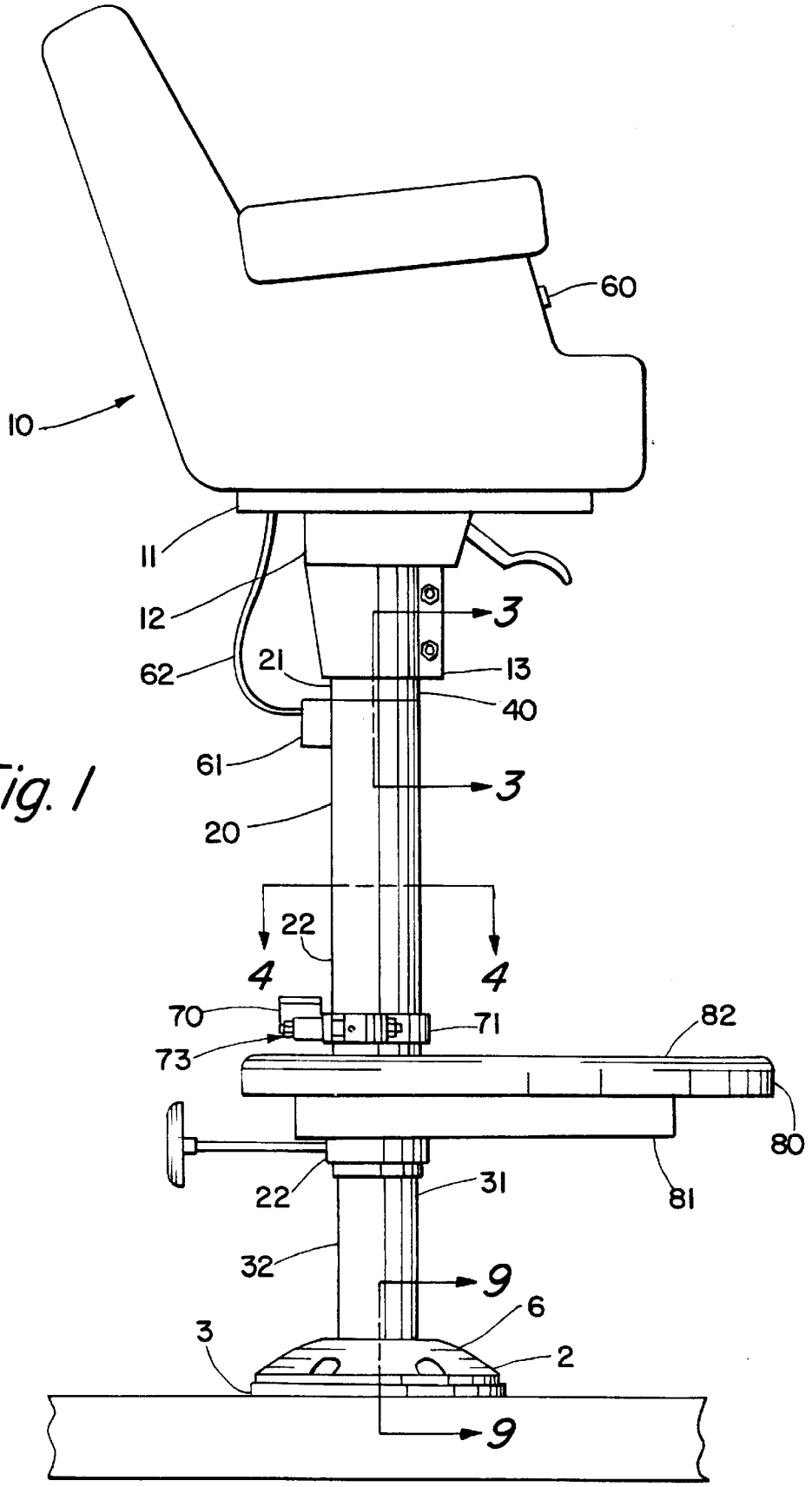
FIG. 1 is a side view of the adjustable helmsman's chair.

Referring now specifically to FIG. 1, an adjustable Helmsman's chair of the present invention is generally designated by reference numeral 1 and includes a boat deck bracket 2 that's adapted to be mounted to a boat deck. A chair 10 is mounted on a chair mounting bracket 11. An outer member 20 is provided with an upper end 21 and a lower end 22. An inner member 30 is provided with an upper end 31 and a lower end 32. As shown in FIG. 1, the inner member lower end 32 is adapted to be connected to boat deck bracket 2. Inner member 30 remains stationary while upper member 20 moves vertically.

Figure 7:
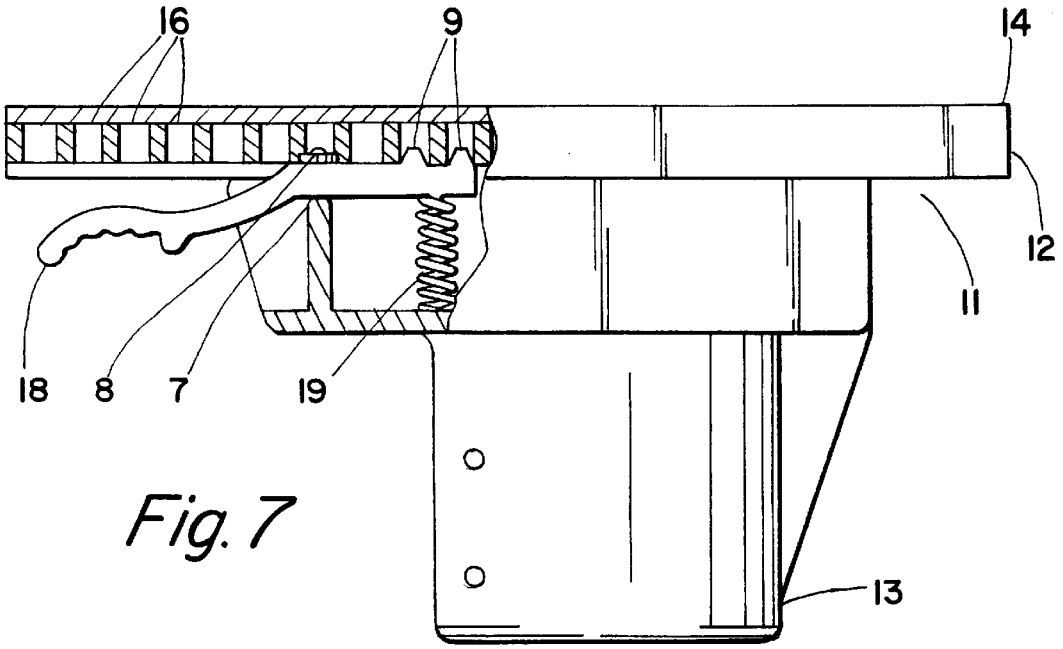
FIG. 7 is a fragmental side elevation of the chair mounting bracket with the components shown in section.
Figure 8:
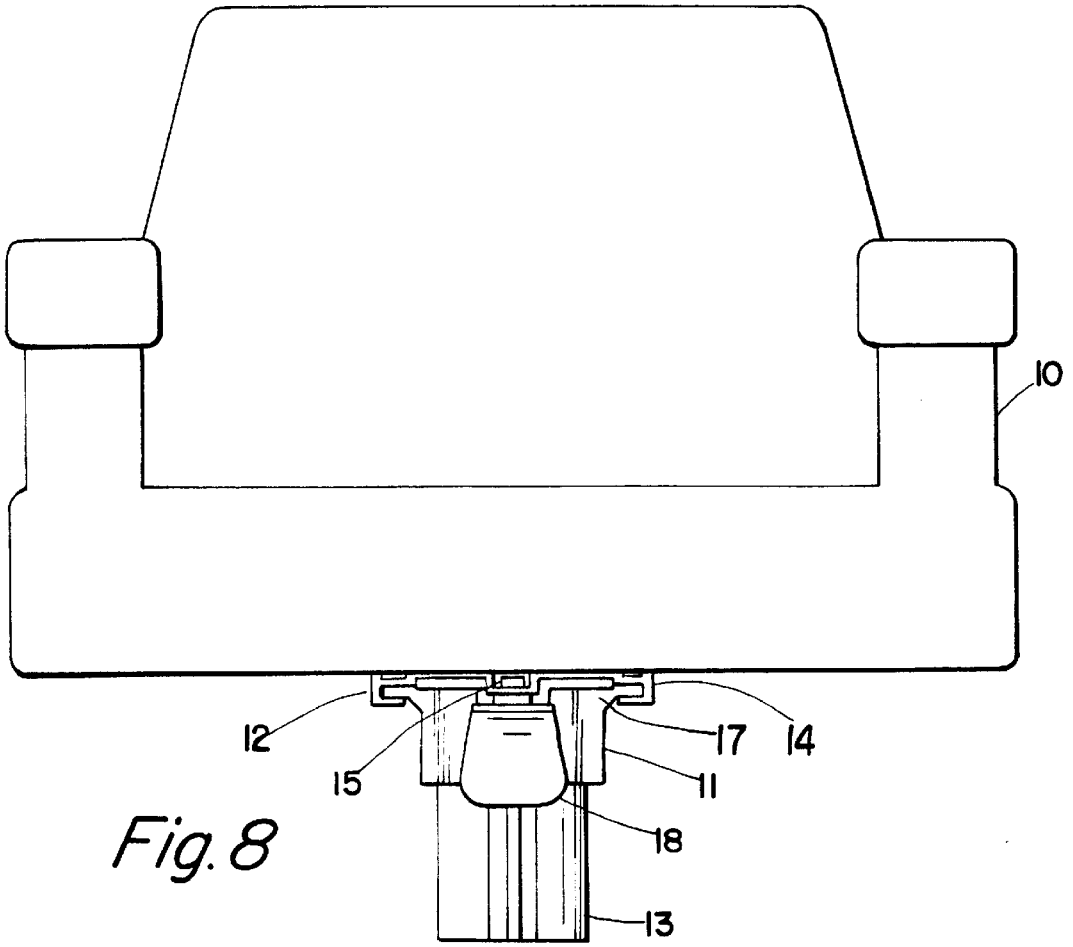
FIG. 8 is a fragmental front elevation of the chair mounting bracket.

Referring to FIGS. 7 and 8, the chair mounting bracket 11 comprises a bracket housing 8 and bracket upper end 12 and bracket lower end 13. A carriage 14 is provided on the bracket upper end 12 and attached to the chair 10. The carriage 14 is dimensioned with a central channel 15 having at least one slot 16 along the channel. A rail 17 is mounted on the bracket lower end 13 and is slidably engaged with carriage 14. A seat lever 18 is mounted forwardly of the chair 10 below the rail 17 and pivotally engaged with bracket housing 8 at pivot point 7. At least one lever pin 9 is dimensioned on an end of the seat lever 18 and is dimensioned to fit within slot 16. A spring 19 is connected to the seat lever 18 and housing 8 so that the lever pin 9 is forcibly engaged to fit within slot 16. Chair 10 then cannot move horizontally along rail 17. When seat lever 18 is raised, the lever pin 9 is removed from slot 16 and the carriage 14 may move horizontally along rail 17.

Figure 2:
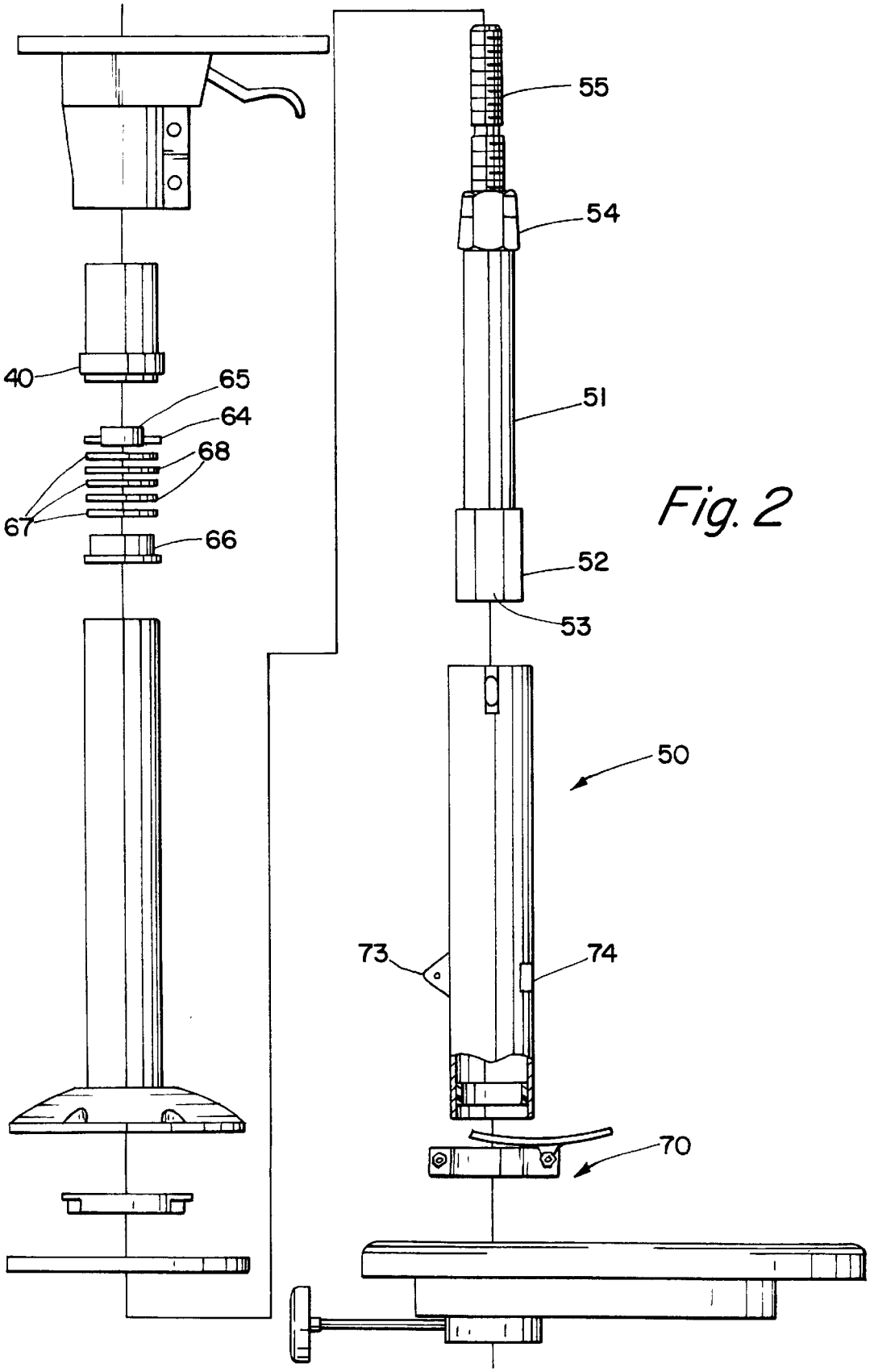
FIG. 2 is an exploded view of the adjusting means of the helmsman's chair and its fit with the outer member.

Referring to FIG. 2, means for adjusting chair height 50 is disclosed with a cylinder 51, bottom cap 52 placed at the bottom of cylinder 51 and dimensioned with a cut out 53. As disclosed in FIG. 11 this cut out 53 fits into hydraulic cylinder mounting plate 57 that is part of boat deck bracket 2. Top cap 54 is placed on cylinder 51 and dimensioned to allow cylinder shaft 55 to fit centrally thereof. In the preferred embodiment the cylinder 51 is hydraulically operable to raise and lower cylinder shaft 55. As shown in FIG. 11, power means 56 is connected to the cylinder 51 and the switch 60 (which is shown in FIG. 1). When the switch 60 is engaged, hydraulic fluid in the preferred embodiment operates to raise or lower the cylinder shaft 55 as desired.

Figure 3:
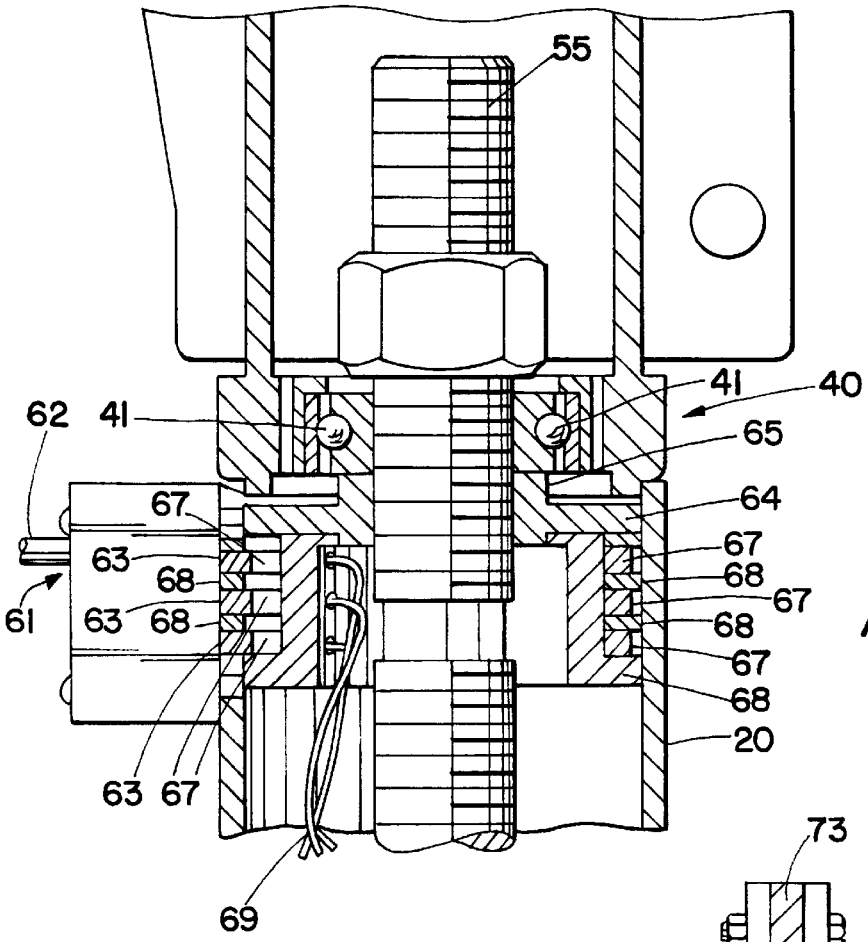
FIG. 3 is a vertical sectional view taken substantialy along section line 3—3 of FIG. 1 with the components shown in section.

Referring to FIGS. 1 and 3, bearing housing 40 is attached to chair mounting bracket 11 and outer member 20. The bearing housing 40 is preferably welded on the outer member 20 so that outer member 40 and chair 10 rotates. As shown in FIG. 3, the bearing housing 40 has bearings 41 that are seated at the central and bottom area thereof.

Referring to FIG. 1, the switch 60 is designed with three positions, to raise, lower, or off. Referring to FIGS. 1 and 3, a brush assembly 61 is attached to the outer member 20 at a location below bearing housing 40. As disclosed in FIG. 3, brush assembly 61 is electrically connected to switch 60 (not shown) by wire 62. The brush assembly 61 is provided with three brushes 63 that are adapted to be urged through the outer member 20.

Referring to FIGS. 2 and 3, switch commutator 64 with top end 65 is mounted on cylinder shaft 55. As more fully disclosed in FIG. 4, the switch commutator 64 includes mandril 66 that is mounted directly on cylinder shaft 55 and remains stationary therewith. Three contact rings 67 are attached to mandril 66 and separated by spacers 68 as shown in FIG. 3. Brushes 63 are dimensioned to fit directly in and touch a contact ring 67. The contact rings 67 are preferably of an electrically conductive material such as brass, while the spacers 68, mandrill 66, and top end 65 are made of an electrically unconductive materials such as micarta. The top end 65 is dimensioned to allow the bearing house 40 to sit on it. Bearing housing 40 contains bearings shaft 48 that rotates on bearings 41. The bearing shaft 48 is fixedly connected to the cylinder shaft 55 by cylinder shaft nut 59. In operation, the bearing housing 40 attached to outer member 20 with chair 10 rotates on the top end 65 as the cylinder shaft does not rotate, but moves vertically.

Wiring harness 69 is connected to contact rings 67 on the one hand and power means 56 as disclosed in FIG. 12 so that when the switch is operated a signal is sent to the power means 56 to raise or lower the chair 10 disclosed in FIG. 1. A very important feature of my invention is the use of this switch 60, brush assembly 61, and switch commutator 64. As the chair 10 rotates, electrical contact is maintained to control its vertical elevation and it may rotate at the same time. This design is very advantageous during the hard use on board an operating boat.

Figure 4:
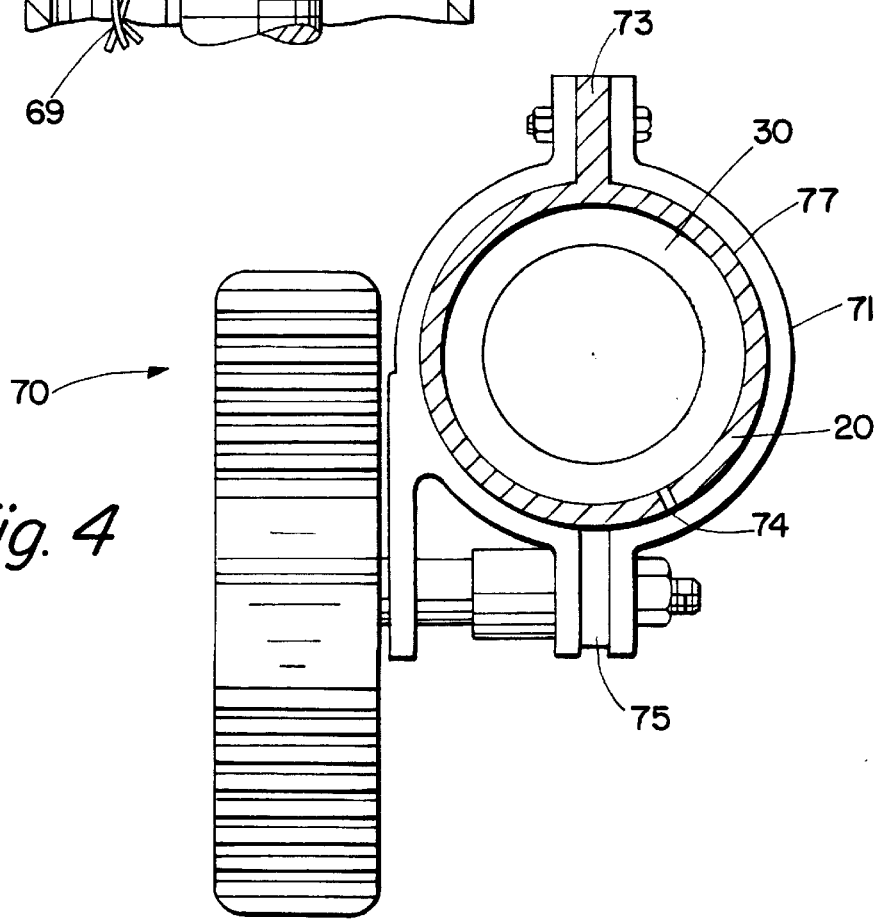
FIG. 4 is an enlarged horizontal section view taken substantially along section line 4—4 of FIG. 1 illustrating the structural retails of the locking means with components shown in section.

Referring to FIGS. 1 and 4, locking means 70 is provided with a locking ring 71 that fits around outer member 20 and is attached to locating bracket 73 mounted on outer member 20. A generally U-shaped slit 74 is located on the outer member 20 opposite the locating bracket 73 as disclosed in FIG. 2. A cam 75 is mounted within locking ring 71 and located about the slit 74. In operation, cam lever 76 attached to cam 75 with cam bolt 79 is engaged to rotate the cam 75. The cam 75 as it rotates, it urges the slit 74 against the inner member 30, thereby locking the chair 10 in place. This prevents rotation as well as vertical change. An insert 77 preferably of a nylon material is fit on the inside diameter of slit 74 and the outer member 20 to prevent wear on the inner member 30 as shown in FIG. 4.

Referring to FIG. 2, a sleeve 78 is attached to the inside diameter of outer member lower end 22 so as to permit outer member 20 to glide on inner member 30.

Figure 5:
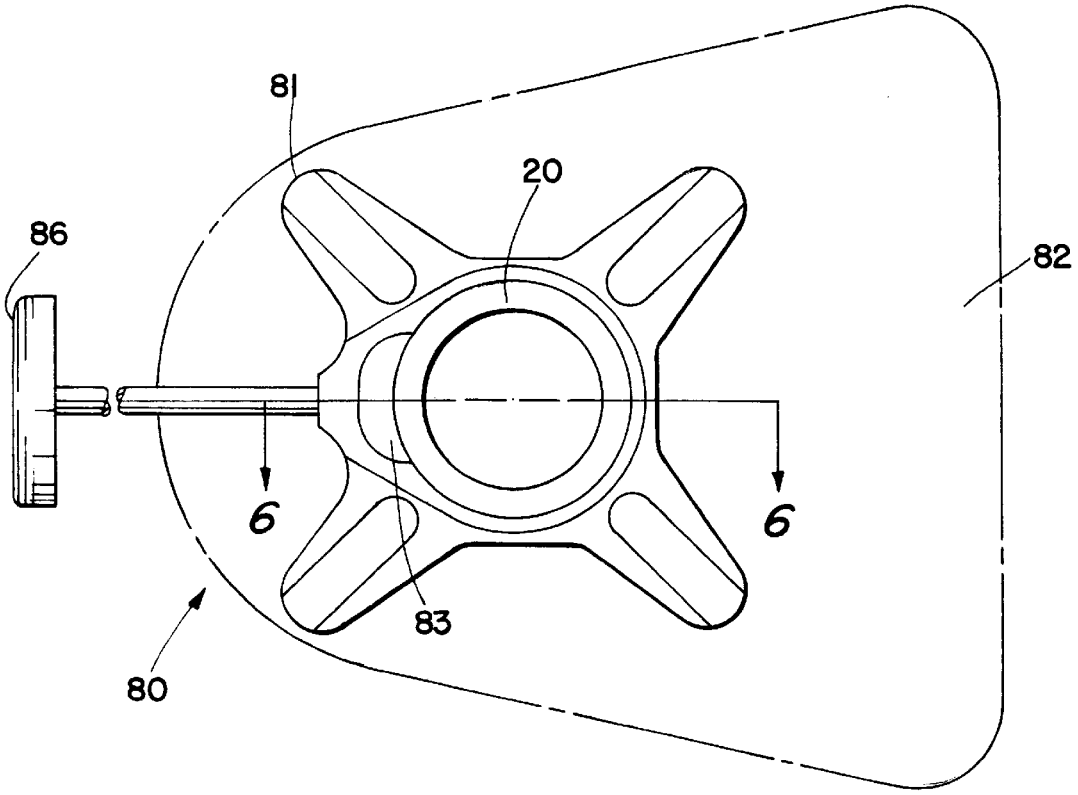
FIG. 5 is an enlarged bottom view of the foot rest mounting bracket.
Figure 6:
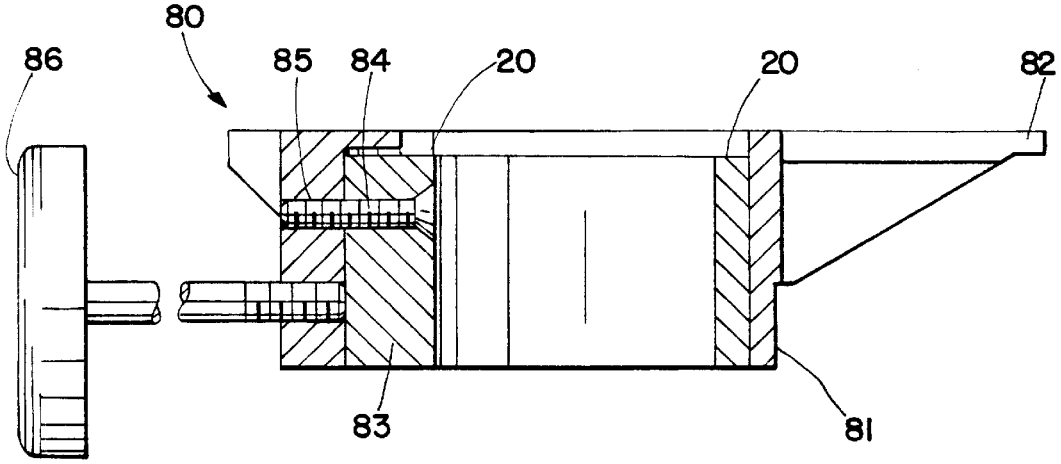
FIG. 6 is a horizontal sectional view of the foot rest mounting bracket taken substantially along section line 6—6 of FIG. 5 illustrating the structured details of the foot rest mounting bracket with components shown in the section.

Referring to FIGS. 1, 5, and 6, adjustable foot rest platform 80 is slidably mounted on outer member 20. An adjustable foot rest platform 80 is provided with foot rest housing 81. A foot rest 82 is attached to foot rest housing 81. As shown in FIGS. 5 and 6, a knob 86 fits through the foot rest housing 81 and is attached to clamp pad 83. A slide pin 84 fits in clamp pad 83 and is slidably engaged with slide pin receptacle 85 dimensioned in the foot rest housing 81. In the operation of the preferred embodiment the knob 86 has threads and is fit through the foot rest housing 81 so that the threads are engaged therewith. As the knob 86 is rotated through foot rest housing 81, the clamp pad 83 is urged against the outer member 20 rendering it stationary thus an operator can easily raise or lower the foot rest 82 as desired.

Referring to FIGS. 1, 9, and 10, a boat deck bracket 2 is provided to install the adjustable helmsman's chair 1 by attaching it to a boat deck. A base support plate 3 is mounted on the deck and is dimensioned with a central opening 4. Hydraulic cylinder mounting plate 57 with cylinder risers 58 attached thereto is connected to the bottom cap 52 as shown in FIG. 10. The cylinder risers 58 allow wiring harness 69 to fit through the central opening 4. The cylinder risers 58 connect directly to the cylinder mounting plate 57 so that there is sufficient space for the power means 56 connections. The inner member 30 is preferably welded to the base plate mounting bracket 6. Hydraulic cylinder mounting plate 57 preferably is off set so that it fits on base support plate 3 and can be fixedly engaged therewith. Base plate mounting bracket 6 is adapted to connect the inner member 30 with base support plate 3 that holds hydraulic cylinder mounting plate 57 stationary. Deck mounting screws 5 are then engaged through the base plate mounting bracket 6 to tighten base mounting plate 3, inner member 30 and hydraulic cylinder plate 57 in place.

The foregoing is considered as an illustration only of the principles of my invention. Numerous modifications and changes will readily occur to those skilled in the art. It is not desired to limit the invention to the exact construction and operation shown and described, accordingly all modifications and equivalents thereof may be used and still fall within the scope of the claimed invention. What is claimed as new is as follows:

I claim:

1. An adjustable helmsman's chair comprising:

a boat deck bracket attached to a boat deck; a pedestal adapted to be mounted to the boat deck bracket, having an inner member with an upper and lower end and an outer member with an upper and lower end, said inner member remaining stationary; a chair mounting bracket rotatably attached to an upper end of the outer member; a chair mounted to the chair mounting bracket; means for adjusting the height of the chair, by vertically raising and lowering the outer member and connected to the boat deck bracket; a switch attached to the chair and electrically connected to the means for adjusting to control the said outer member's vertical movement; and locking means attached to the outer member adapted to force the outer member against the inner member to lock the chair in place to prevent both vertical motion as well as rotational motion when engaged.

2. The adjustable helmsman's chair of claim 1 wherein the chair mounting bracket further comprises:

a carriage attached to the chair dimensioned with a central channel having slots along the channel; a rail mounted on the upper end of the outer member dimensioned to fit within the carriage so that the carriage would slide on the rail; a seat lever mounted on the outer member below the rail to a front part thereof; a spring attached to one end of the lever and another end to a lower end of the mounting bracket; a lever pin dimensioned on the lever end connected to the spring that would fit within a slot in the central channel so that when the lever is engaged the lever pin is removed from the slot and the chair slides upon the rail and when the lever is not engaged, the lever pin would fit in a slot to prevent movement along the rail.

3. The adjustable helmsman's chair of claim 1 further comprising:

an adjustable foot rest platform attached to the outer member and movable to a desired location below the chair.

4. The adjustable helmsman's chair of claim 3 wherein said adjustable foot rest platform comprises:

a foot rest mounting bracket dimensioned to fit around the outer member; a clamp pad dimensioned to fit within the foot rest mounting bracket and adapted to be urged against the outer member; a slide pin attached to the clamp pad and fit within the foot rest mounting bracket to guide the clamp pad against the outer member; a knob with two ends attached to the clamp pad on one end and going through the foot rest mounting bracket on the other so as to urge the clamp pad against the outer member to render the foot rest mounting bracket stationary; and a foot rest attached to the foot rest mounting bracket.

5. The adjustable helmsman chair of claim 1 wherein the locking means further comprises:

a locating bracket attached to the outer member; a generally U-shaped slit in the outer member placed opposite the locating bracket; a locking ring attached to said locating bracket; a cam mounted within the ring and located about the slit, and a cam lever attached to the cam so that when the lever is operated, the cam is rotated to force the slit against the inner member, thereby locking the outer member in place.

6. The adjustable helmsman chair of claim 5 further comprising:

an outer member having an inside diameter and an outside diameter; an insert attached to the inside diameter of the outer member at the location of the slit; and a sleeve placed on an inside portion of the outer member so that the outer member slides on the sleeve.

7. The adjustable helmsman's chair of claim 1 wherein the means for adjusting further comprises:

a bottom cap connected to the boat deck bracket; a cylinder placed above the bottom cap adapted to remain stationary therewith; a top cap placed on the cylinder; and a cylinder shaft that goes through the top cap and is vertically adjustable relative to the cylinder; a power means connected to said cylinder and electrically connected to the switch so that the chair is raised and lowered as desired upon operation of the switch.

8. The adjustable helmsman chair of claim 7 further comprising:

a bearing housing mounted below the chair mounting bracket and above the outer member; bearings seated in the bearing housing; a bearing shaft connected to the top of the cylinder shaft with the bearings in slidable contact therewith so that the chair rotates on the bearings while the inner member and cylinder shaft remains stationary.

9. The adjustable helmsman chair of claim 7, wherein said switch further comprises:

a three position switch attached to the chairs one position to raise, one to lower, and one off; a brush assembly attached to the outer member and electrically connected to the switch, having three brushes that are adapted to be urged through the outer member toward adjusting means.

10. The adjustable helmsman chair of claim 9 further comprising:

a switch commutator with a top end adapted to be mounted to the cylinder shaft having; a mandrill; three contact rings separated by spacers, said contact rings being of an electrically conductive material while the spacers and the mandrill being of an unconductive material; the top end placed on the top thereof, said commutator contact rings dimensioned so each brush fits within when urged against the contact ring creating an electrical contact; and a wiring harness connected to the commutator contact rings and the power means.

* * * * *